US006082136A

United States Patent [19]

Yoshino

[11] Patent Number: 6,082,136

[45] **Date of Patent: *Jul. 4, 2000**

[54] OXYGEN GAS MANUFACTURING EQUIPMENT

[75] Inventor: Akira Yoshino, Osakasayama, Japan

[73] Assignee: Daido Hoxan Inc., Sapporo, Japan

[ * ] Notice: This patent issued on a continued prosecution application filed under 37 CFR 1.53(d), and is subject to the twenty year patent term provisions of 35 U.S.C. 154(a)(2).

[21] Appl. No.: 08/796,746

[22] Filed: Feb. 7, 1997

Related U.S. Application Data

[63] Continuation of application No. 08/456,344, Jun. 1, 1995, abandoned.

[30] Foreign Application Priority Data

Nov. 12, 1993 [JP] Japan ..... 5-283575

[51] Int. Cl.[7] ..... F25J 3/00

[52] U.S. Cl. ..... 62/652; 62/654

[58] Field of Search ..... 62/652, 654, 910, 62/913

[56] References Cited

U.S. PATENT DOCUMENTS

| | | | |
|---|---|---|---|
| 2,788,646 | 4/1957 | Rice | 62/913 X |
| 2,908,144 | 10/1959 | First et al. | 62/913 X |
| 3,056,268 | 10/1962 | Grenier | 62/913 X |
| 3,736,762 | 6/1973 | Toyama et al. | 62/39 X |
| 4,496,383 | 1/1985 | Hubbard et al. | 62/39 X |
| 4,526,595 | 7/1985 | McNeil | 62/39 X |
| 4,530,708 | 7/1985 | Nakazato et al. | 62/39 X |
| 4,560,397 | 12/1985 | Cheung | 62/652 |
| 4,566,887 | 1/1986 | Openshaw | 62/39 X |
| 4,732,595 | 3/1988 | Yoshino | 62/913 X |
| 4,936,099 | 6/1990 | Woodward et al. | 62/652 |
| 5,034,043 | 7/1991 | Rottmann | 62/652 |
| 5,084,081 | 1/1992 | Rohde | 62/913 X |
| 5,144,808 | 9/1992 | Ha | 62/41 X |
| 5,349,822 | 9/1994 | Nagamura et al. | 62/39 |
| 5,396,722 | 3/1995 | McKeigue et al. | 62/39 X |
| 5,475,980 | 12/1995 | Grenier et al. | 62/654 X |

FOREIGN PATENT DOCUMENTS

| | | | |
|---|---|---|---|
| 0653456 | 12/1962 | Canada | 62/652 |
| 33 07 181 A1 | 9/1984 | Germany . | |
| 3204582 | 9/1991 | Japan | 62/652 |

OTHER PUBLICATIONS

European Search Report dated Oct. 30, 1995; Ref. No: HRW/36626.

*Primary Examiner*—William Doerrler
*Attorney, Agent, or Firm*—Armstrong, Westerman, Hattori, McLeland & Naughton

[57] ABSTRACT

There are included a fractionating tower for liquefying and separating the compressed air cooled by heat exchangers to an ultralow temperature, a liquid oxygen takeout path for guiding the liquid oxygen in the above-mentioned fractionating tower to the above-mentioned heat exchangers to gasify so as to become a gasified oxygen, and a product oxygen gas takeout path which extends from the front end of the above-mentioned liquid oxygen takeout path and increases the temperature of the above-mentioned gasified oxygen so as to obtain a product oxygen gas, the above-mentioned liquid oxygen takeout path being provided with an oxygen gas pressurizing pump, and the above-mentioned product oxygen gas takeout path on the side upstream the above-mentioned heat exchangers being provided with an expansion turbine. In the present invention, the liquid oxygen taken out from the fractionating tower is pressurized in a liquid state, then introduced into the expansion turbine to generate a cold, which cold is fed to the heat exchangers, so that the cold is used as a cold source for the entire equipment to reduce the cost of generating the cold.

2 Claims, 3 Drawing Sheets

OXYGEN GAS MANUFACTURING EQUIPMENT

This application is a continuation of application Ser. No. 08/456,344 filed Jun. 1, 1995, now abandoned.

FIELD OF ART

The present invention relates to an oxygen gas manufacturing equipment capable of obtaining oxygen gas in a pressurized state.

PRIOR ART

Heretofore, oxygen gas has been manufactured by the use of an air separation equipment in which oxygen is separated from nitrogen by utilizing a difference in boiling point between the two. Such a typical air separator, as shown in FIG. 3, has a construction in which a raw air is sucked from a raw air suction pipe 1, compressed in an air compressor 2, cooled through a pipe 3 and through a first and a second heat exchangers 4, 5 near to a liquefying point, and then introduced in that state through a pipe 7 into a lower tower 8' of a fractionating tower 8. Part of the compressed air having passed through the above-mentioned first heat exchanger 4 is adapted to be fed through a branch pipe 3*a* to an expansion turbine 11, in which the air is adiabatically expanded to develop the cold required for the equipment, and to be introduced in that state into an upper tower 8". In the above-mentioned lower tower 8', the air is fractionated, so that a liquid air rich in oxygen is accumulated in the bottom portion of the lower tower 8', while nitrogen in a gaseous state is moved upward and drawn by a pipe 10 from the tower top of the lower tower 8'. The nitrogen gas thus drawn is heat exchanged in the second and first heat exchangers 5, 4 to become a product nitrogen gas with a near room temperature, and drawn from a pipe 19. Part of the nitrogen gas drawn from the tower top of the lower tower 8' is introduced through a pipe 17 into a condenser 16 of the upper tower 8", in which condenser it is liquefied to become liquid nitrogen, part of which is fed from a pipe 13 to the tower top of the upper tower 8", and the remainder of the part flows from a pipe 18 down into the lower tower 8' to become a reflux liquid thereof. Introduced into the upper tower 8" is the liquid air rich in oxygen from the bottom portion of the lower tower 8' by a pipe 12 with an expansion valve 12'. In the upper tower 8", the liquid air is fractionated, so that a liquid oxygen 9 is accumulated in the bottom portion, while an exhaust gas rich in nitrogen is drawn from the tower top by a pipe 14. The exhaust gas thus drawn is released through the second and first heat exchangers 5, 4 into the atmosphere. The liquid oxygen is drawn from the bottom portion of the upper tower 8" by a pipe 10', and through the second and first heat exchangers 5, 4, gasified to become oxygen gas, then compressed in an oxygen gas compressor 15 to become a product oxygen gas in a pressurized state, and supplied to a demand.

In such an air separation equipment, when trying to obtain the product gas in a pressurized state, a gas in a gaseous state must be pressurized by the oxygen gas compressor 15. However, there is a disadvantage that a significant energy is required to pressurize the above-mentioned gas in a gaseous state, thereby causing an increased cost.

OBJECT OF THE INVENTION

The present invention is made in view of such circumstances and it is an object of the invention to provide an oxygen gas manufacturing equipment capable of manufacturing efficiently oxygen gas in a pressurized state at a low cost.

SUMMARY OF THE INVENTION

In order to achieve the above-mentioned object, the present invention includes air compression means for compressing a raw air, heat exchange means for cooling the above-mentioned compressed air to an ultralow temperature, a fractionating tower for liquefying and separating the compressed air cooled to the above-mentioned ultralow temperature and holding nitrogen in a gaseous state, a liquid oxygen takeout path for guiding the liquid oxygen in the above-mentioned fractionating tower as a cooling medium to the above-mentioned heat exchange means in which the liquid oxygen is gasified by heat exchange to become a gasified oxygen, and a product oxygen gas takeout path which extends from the front end of the above-mentioned liquid oxygen takeout path and passes through the above-mentioned heat exchange means to increase the temperature of the above-mentioned gasified oxygen so as to obtain a product oxygen gas; and the invention has a composition in which the above-mentioned liquid oxygen takeout path is provided with pressurization means for pressurizing the liquid oxygen passing through the takeout path, and in which the portion of the above-mentioned liquid product oxygen gas takeout path on the side upstream the above-mentioned heat exchange means is provided with a cold heat generating expander utilizing a gasified oxygen passing through the takeout path.

That is, the oxygen gas manufacturing equipment of the present invention takes out the liquid oxygen accumulated in the upper tower of the fractionating tower, pressurizes it in a liquid state, feeds it to the heat exchangers, introduces it into the expansion turbine to adiabatically expand so as to generate a cold, and feeds the generated cold to the heat exchangers to use as a cold source of the entire equipment. Thus, in the present invention, oxygen in a liquid state is pressurized, so that the pressurizing cost is significantly reduced compared with a case where oxygen in a gaseous state is pressurized (for example, one mol of oxygen is 22.4 liters in a gaseous state, while it is only 16 grams in a liquid state). Also, in the present invention, as described above, oxygen in a liquid state is pressurized, and gasified through the heat exchangers, and the gasified oxygen is utilized as a drive source for the cold heat generating expander such as the expansion turbine, so that the pressure of the oxygen gas before entering the expansion turbine becomes large, thereby allowing an efficiency in adiabatical expansion to be significantly improved. As a result, the cost of generating a cold by the cold heat generating expander such as the expansion turbine can be markedly reduced, thereby lowering the cost of the product oxygen gas.

EFFECTS OF THE INVENTION

As described above, the oxygen gas manufacturing equipment of the present invention takes out the liquid oxygen accumulated in the upper tower of the fractionating tower, and pressurizes it in a liquid state to manufacture the product oxygen in a pressurized state. Thus, in the present invention, oxygen in a liquid state is pressurized, so that the pressurizing cost is significantly reduced compared with a case where oxygen in a gaseous state is pressurized. Also, in the present invention, as described above, oxygen in a liquid state is pressurized, and gasified through the heat exchangers, and the gasified oxygen is utilized as a drive source for the cold heat generating expander such as the expansion turbine. As a result, the pressure of the oxygen gas before entering the expansion turbine becomes large, whereby an efficiency in adiabatical expansion can be significantly improved, and the cost of manufacturing the product oxygen gas an the like be markedly lowered. The equipment of the present invention is utilized effectively for a wide field for steel manufacture, chemical industry, thermal power generation and the like.

With reference to the drawings, the present invention will be explained in detail hereinafter.

Figure 1:
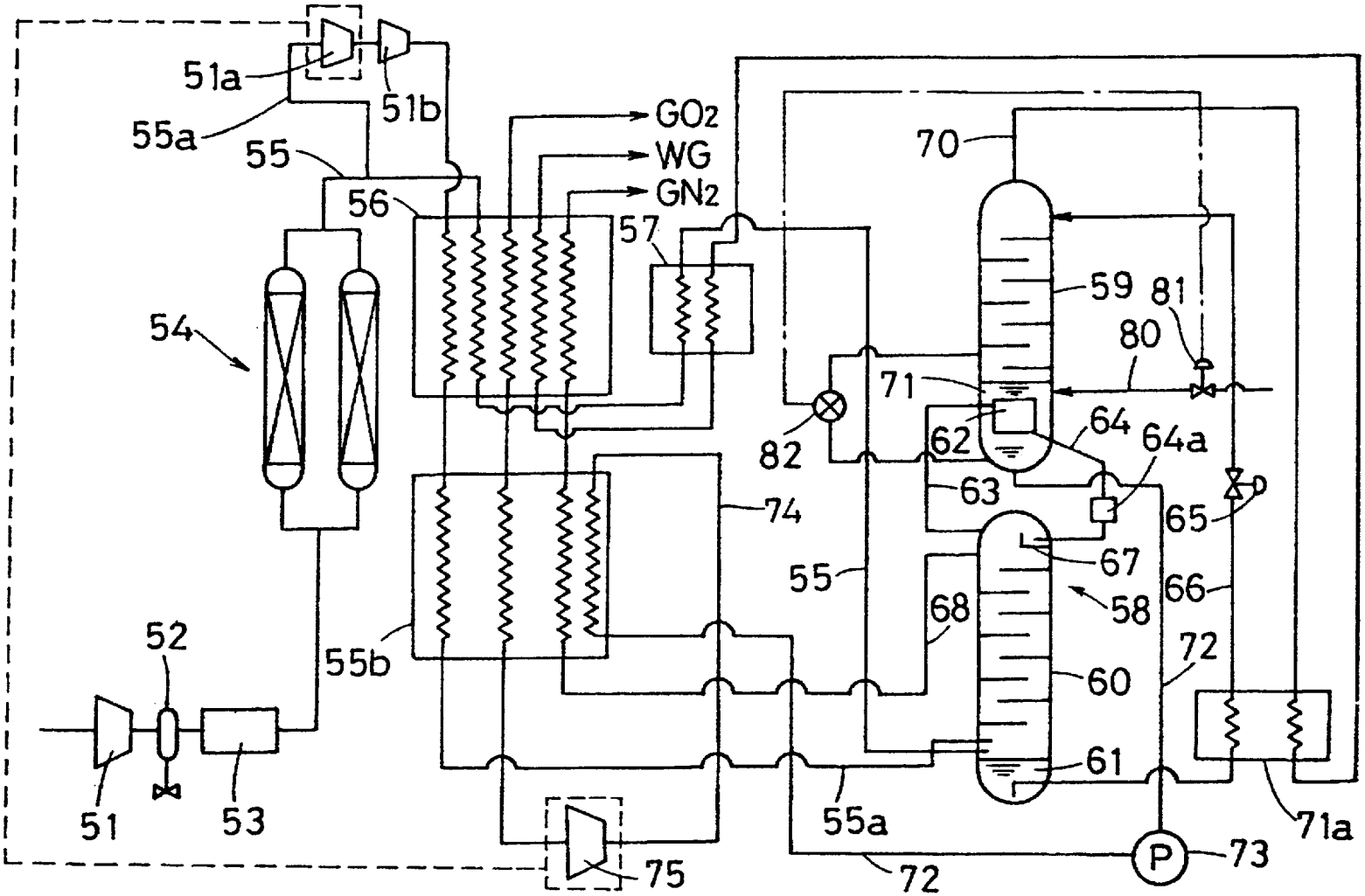
FIG. 1 is a block diagram of one embodiment of the present invention.

FIG. 1 shows one embodiment of the present invention. In the figure, reference code 51 designates an air compressor for compressing a raw air; 52, a drain separator; 53, a flon cooler; and 54, a set of absorption towers consisting of two towers. The absorption towers 54, in which molecular sieves are packed, absorb impurities such as $H_2O$, $CO_2$ and CO in the air compressed by the air compressor 51. Reference code 55 designates a compressed air feeding pipe for feeding the compressed air from which impurities have been removed; and 55*a* designates a branch pipe branching off the compressed air feeding pipe 55. Reference code 56 designates a first heat exchanger into which the compressed air from which impurities have been removed by the absorbing towers 54 is fed. Reference code 57 designates a second heat exchanger into which the compressed air having passed through the first heat exchanger 56 is fed. The compressed air having passed through the first and second heat exchangers 56, 57 is fed in a gaseous state into a lower tower 60. Reference codes 51*a,* 51*b* designate air compressors provided in the branch pipe 55*a,* of which the upstream air compressor 51*a* compresses part of the compressed air passing through the compressed air feeding pipe 55*a,* and the downstream air compressor 51*b* compresses further the compressed air compressed by the upstream air compressor 51*a.* The upstream air compressor 51*a* is driven by a power from an expansion turbine 75. Reference code 55*b* designates a third heat exchanger into which the compressed air compressed by the air compressors 51*a,* 51*b* and cooled by the first heat exchanger 56 is fed. The compressed air having passed through the air compressors 51*a,* 51*b* and the first and third heat exchangers 56, 55*b* is fed in a liquid state into the lower tower 60. Reference code 58 designates a fractionating tower including an upper tower 59 and the lower tower 60, The lower tower 60 is adapted to cool further the compressed air cooled by the the first and second heat exchangers 56, 57 to an ultralow temperature and fed into through the compressed air feeding pipe 55, to liquefy part thereof so as to accumulate as a liquid air 61 in the bottom portion, and to accumulate nitrogen in a gaseous state in the upper portion. The lower tower 60 is also adapted to accumulate the compressed air fed into through the branch pipe 55*a* in the bottom portion of the lower tower 60. Contained in the bottom portion of the upper tower 59 is a condenser 62, into which part of the nitrogen gas accumulated in the upper portion of the lower tower 60 is fed through a first reflux liquid pipe 63. The inside of the upper tower 59 is at a pressure lower than that of the lower tower 60, so that the liquid air 61 ($N_2$ 50 to 70%, $O_2$ 30 to 50%) accumulated in the lower portion of the lower tower 60 is fed into a pipe 66 with an expansion valve 65, supercooled by a subcooler 71*a,* reduced in pressure by the expansion valve 65, and then fed into the upper tower 59, thereby cooling the inside temperature of the upper tower 59 to a temperature equal to or lower than the boiling point of liquid nitrogen. This cooling causes the nitrogen gas fed into the condenser 62 to be liquefied. The nitrogen gas thus liquefied is introduced through a second reflux liquid pipe 64 into the upper portion of the lower tower 60 as a reflux liquid, which liquid flows through a liquid nitrogen reservoir 67 downward in the lower tower 60, and contacts in a countercurrent manner the compressed air rising from the bottom portion of the lower tower 60, thereby cooling the compressed air and liquefying part thereof. In this process, the oxygen gas of a high-boiling point component in the compressed air is liquefied and accumulated in the bottom portion of the lower tower 60, while the nitrogen gas of a low-boiling point component is accumulated in the upper portion of the lower tower 60. Reference code 64*a* designates a gas-liquid separator. Reference code 68 designates a takeout pipe for taking out the nitrogen gas accumulated in the ceiling portion of the lower tower 60 as a product nitrogen gas, which pipe guides the nitrogen gas at an ultralow temperature into the third and first heat exchangers 55*b,* 56, and allows the gas to be heat exchanged with the compressed air fed thereinto so as to become room temperature, thereby delivering it as a product nitrogen gas. On the other hand, the liquid air having been fed from the bottom portion of the lower tower 60 through the pipe 66 into the upper tower 59 is subject to a fractionating action in the upper tower 59, whereby the oxygen of a high-boiling component in the liquid air is liquefied and accumulated as a liquid oxygen 71 in the bottom portion of the upper tower 59. Reference code 80 designates a pipe for feeding the liquid oxygen into the upper tower 59 when the oxygen gas manufacturing equipment is started. The pipe 80 extends from a liquid oxygen storage tank not shown. Stored in the tank is the liquid oxygen manufactured by the equipment or the one manufactured by another equipment and transported by a tank lorry and the like. Reference code 81 designates a liquid oxygen feeding control valve, which is opened according to the level of a level gauge 82 when a cold balance is loosed to cause a cold source to tend to be short during operation, thereby feeding a cold liquid oxygen to keep the balance of fractionating. A gas of a low-boiling point component containing nitrogen gas is drawn from the tower top of the upper tower 59 by a pipe 70 as an exhaust gas, acts as a cold source of the subcooler 71*a,* and then released through the second and first heat exchangers 57, 56 into the atmosphere. The liquid oxygen 71 accumulated in the bottom portion of the upper tower 59 is drawn by a liquid oxygen drawing pipe 72, pressurized by a liquid oxygen pressurizing pump 73, and introduced in a pressurized state into the third heat exchanger 55*b* to gasify, thereby becoming a product oxygen gas. The gas is introduced into an oxygen gas takeout pipe 74. Provided in the oxygen gas takeout pipe 74 is the expansion turbine 75, and the product oxygen gas becomes of a drive source of the expansion turbine 75 to generate a cold, enters in this state the second and first heat exchangers 57, 56, in which the gas is heat exchanged with the raw air to give the generated cold to the raw air, with the gas itself exhibiting room temperature, and taken out as a product from the front end of the oxygen gas takeout pipe 74. Particularly, the above-mentioned expansion turbine 75, which uses the product oxygen gas as the drive source, is composed of a material hardly reacting with oxygen, such as a copper alloy (including brass), a nickel alloy (Ni—Cr—Fe), a stainless (SUS 316 L) and an aluminium alloy (Al—Zn), whereby a disaster such as an explosion is prevented. The use of the above-mentioned liquid oxygen pressurizing pump 73 solves a problem with the prior art example (in which there has been a problem with safety that the oxygen gas compressor 15, if catches fire once, will react intensively with oxygen, thus requiring careful precautions in safety practice), and improves significantly the safety.

The equipment manufactures the product oxygen gas in the following manner. That is, a raw air is compressed by the air compressor 51, allowed to pass through the drain separator 52, the flon cooler 53 and the absorption towers 54 for removing impurities, then pass through the first and second heat exchangers 56, 57, and is cooled to a gaseous state at an ultralow temperature, and entered into the lower tower 60 of the fractionating tower 58. At the same time, part of the compressed air having passed through the above-mentioned absorption towers 54 is introduced into the branch pipe 55*a,* allowed to pass through the air compressors 51*a,* 51*b* and the first and third heat exchangers 56, 55*b* to become an ultralow-temperature liquid, and entered into the lower tower 60. In the lower tower 60, the above-mentioned compressed air thus entered is allowed to contact in a countercurrent manner the liquid nitrogen having overflowed the liquid nitrogen reservoir 67 to cool, and part of the air is liquefied and accumulated as the liquid air 61 in the bottom portion of the lower tower 60. In this process, the difference in boiling point between nitrogen and oxygen (boiling point for oxygen of −183° C., that for nitrogen of −196° C.) causes the oxygen as a high-boiling point component in the compressed air to liquefy, thereby leaving nitrogen in a gaseous state. The nitrogen left in a gaseous state is taken out from the takeout pipe 68, and allowed to pass through the third and first heat exchangers 55*b,* 56 so as to be heat exchanged and raised in the temperature thereof near to room temperature, then delivered as the product nitrogen gas. On the other hand, part of the nitrogen gas accumulated in the ceiling portion of the lower tower 60 is introduced through the first reflux liquid pipe 63 into the condenser 62 provided in the upper tower 59, in which the gas is cooled and liquefied by the liquid oxygen accumulated in the bottom portion of the upper tower 59, and drawn through the second reflux liquid pipe 64 into the reflux liquid reservoir 67 of the lower tower 60. The liquid air accumulated in the bottom portion of the lower tower 60 is entered through the pipe 66, the subcooler 71*a* and the expansion valve 65 into the above-mentioned upper tower 59 and subject to a fractionating action. Then, the oxygen as a high-boiling point component is liquefied and accumulated in the bottom portion, while the low-boiling point component gas containing nitrogen gas is delivered as an exhaust gas from the tower top of the upper tower 59 through the pipe 70. The exhaust gas thus delivered passes through the subcooler 71*a* and the second and first heat exchangers 57, 56 so as to be raised in the temperature thereof near to room temperature, and is delivered into the atmosphere. The liquid oxygen 71 accumulated in the bottom portion of the upper tower 59 passes through the pipe 72, and is compressed in a liquid state by the pump 73, and introduced in that state into the third heat exchanger 55*b,* in which the liquid oxygen is heat exchanged to gasify, and introduced into the product oxygen gas takeout pipe 74. Then, the oxygen gas thus introduced is adiabatically expanded by the expansion turbine provided in the product takeout pipe 74 to develop the cold required for the entire equipment, which cold is heat exchanged with the raw air in the third and first heat exchangers 55*b,* 56, whereby the gas itself becomes a room temperature oxygen gas, and is taken out from the front end of the product oxygen gas takeout pipe 74.

Figure 2:
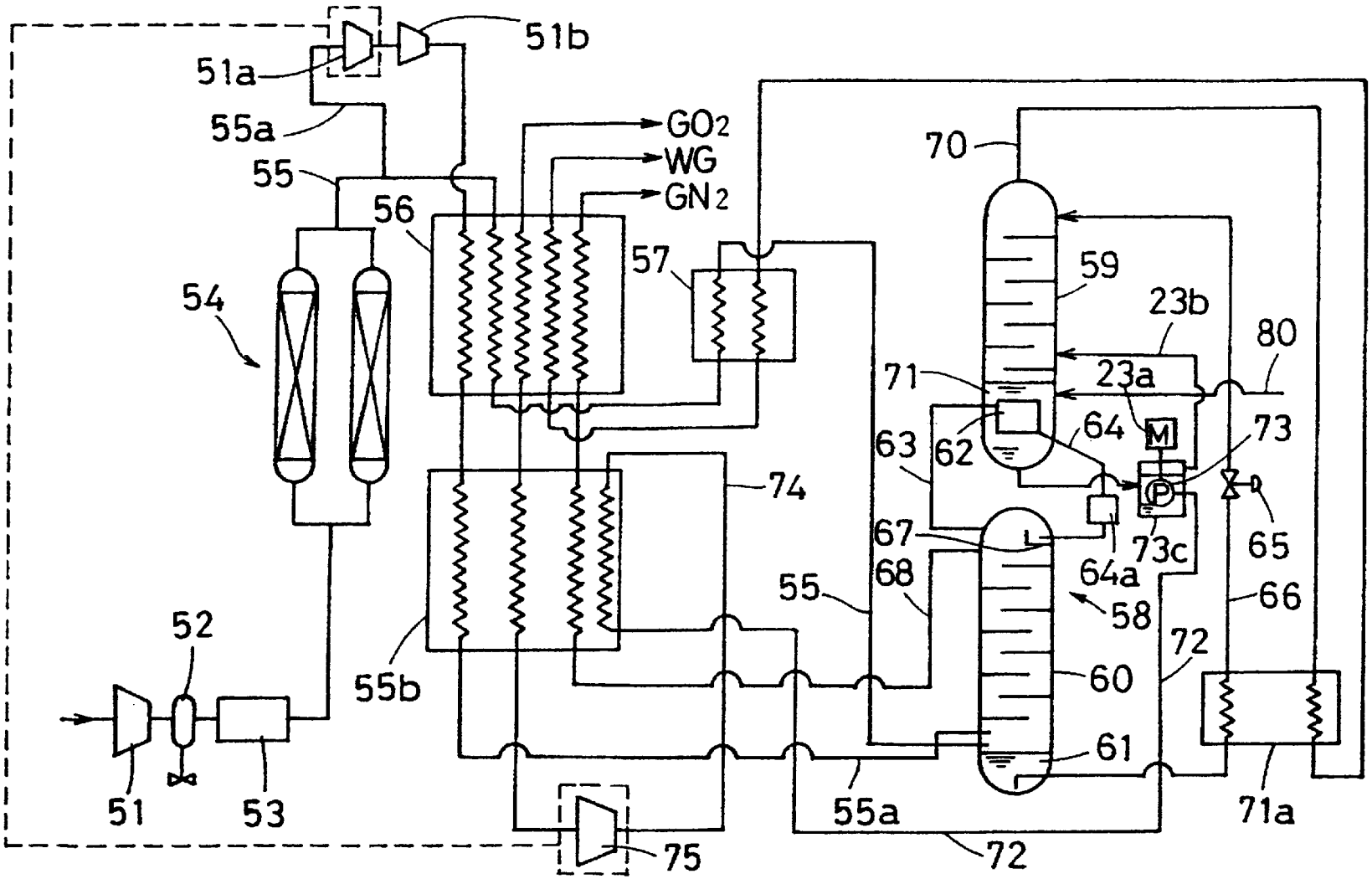
FIG. 2 is a block diagram of another embodiment of the present invention.
Figure 3:
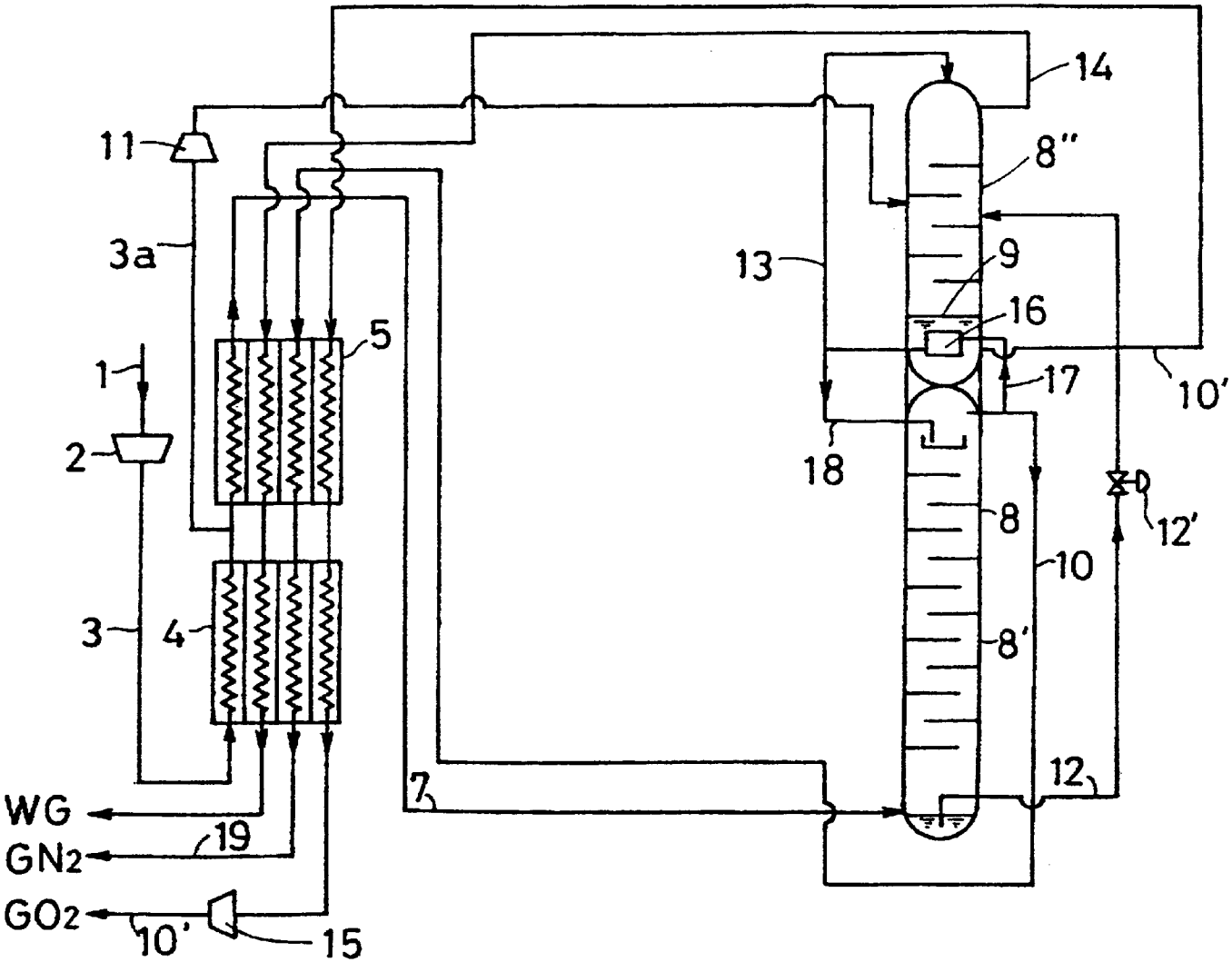
FIG. 3 is a block diagram of a prior art example.

FIG. 2 shows an equipment of another embodiment of the present invention. The equipment is adapted to house a liquid oxygen pressurizing pump in a sealed casing 73*c,* into which a liquid oxygen is introduced and pressurized so as to be drawn to the pipe 72. Then, there is provided a return pipe 23*b* by which the oxygen gas gasified and produced is returned from the above-mentioned casing 73*c* back to the upper tower 59. Parts other than these ones are the same as the equipment of FIG. 1. The composition made in this manner prevents an accident that the liquid oxygen pressurizing pump 73 sucks oxygen gas bubbles to cause a no-load running (a gas biting phenomenon). Reference code 23*a* designates a motor for driving the liquid oxygen pressurizing pump 73.

What is claimed is:

1. An oxygen gas manufacturing equipment comprising a first air compression means for compressing raw air, heat exchange means for cooling the compressed air compressed by the first air compression means to an ultralow temperature, a first means for conveying compressed air cooled by the heat exchange means from the heat exchange means to a fractionating tower, a second air compression means for compressing compressed air compressed by the first air compression means, the heat exchange means for cooling the compressed air compressed by the second air compression means to an ultralow temperature, a second means for conveying the compressed air cooled by the heat exchange means from the heat exchange means to the fractionating tower, the fractionating tower for liquefying and separating the compressed air cooled to the ultralow temperature and holding nitrogen in a gaseous state, a liquid oxygen takeout path for conveying liquid oxygen contained in the fractionating tower as a cooling medium to the heat exchange means in which the liquid oxygen is gasified by heat exchange to become gasified oxygen, and a product oxygen gas takeout path which extends from the liquid oxygen takeout path and passes through the heat exchange means to increase the temperature of the gasified oxygen so as to obtain a product oxygen gas, almost all the liquid oxygen in the fractionating tower being withdrawn by the liquid oxygen takeout path, the liquid oxygen takeout path being provided with pressurization means for pressurizing the liquid oxygen passing through the liquid oxygen takeout path, and the product oxygen gas takeout path on a side upstream the heat exchange means being provided with a cold heat generating expander which utilizes gasified oxygen passing through the product oxygen takeout path, whereby the gasified oxygen is taken out of the cold heat generating expander as a product oxygen gas at a pressure exceeding a pressure of the fractionating tower and the second air compression means is driven by power of the cold heat generating expander.

2. An oxygen gas manufacturing equipment as set forth in claim 1, wherein the cold heat generating expander is an expansion turbine composed of a material having properties.

* * * * *

UNITED STATES PATENT AND TRADEMARK OFFICE

CERTIFICATE OF CORRECTION

PATENT NO. : 6,082,136
DATED : July 4, 2000
INVENTOR(S) : Akira Yoshino

It is certified that error appears in the above-identified patent and that said Letters Patent is hereby corrected as shown below:

Column 6,
Lines 58-60, in the claims portion of the patent change claim 2:

"An oxygen gas manufacturing equipment as set forth in claim 1, wherein cold heat generating expander is an expansion turbine composed of a material having properties."

to be;

-- An oxygen gas manufacturing equipment as set forth in claim 1, wherein cold heat generating expander is an expansion turbine composed of a material which is hardly reactive with oxygen selected from the group consisting of copper alloys, nickel alloys, stainless steels and aluminum alloys. --

Signed and Sealed this

Twenty-third Day of October, 2001

*Attest:*

Nicholas P. Godici

*Attesting Officer*

NICHOLAS P. GODICI
*Acting Director of the United States Patent and Trademark Office*